United States Patent [19]

Stenta

[11] 4,194,104

[45] Mar. 18, 1980

[54] PUSH BUTTON ADAPTER FOR SLIDE SWITCH

[75] Inventor: Richard A. Stenta, Farmville, Va.

[73] Assignee: Stackpole Components Company, Raleigh, N.C.

[21] Appl. No.: 8,067

[22] Filed: Jan. 31, 1979

[51] Int. Cl.[2] ..... H01H 13/56

[52] U.S. Cl. ..... 200/153 J; 200/324; 200/328; 200/330

[58] Field of Search ..... 200/153 J, 153 T, 321–328, 200/330, 5 E; 74/503, 527, 534

[56] References Cited

U.S. PATENT DOCUMENTS

| | | | |
|---|---|---|---|
| 2,331,997 | 10/1943 | Mensenkamp | 74/503 |
| 2,441,614 | 5/1948 | Baumer | 200/153 J X |
| 2,691,702 | 10/1954 | Allison | 200/328 X |
| 2,946,237 | 7/1960 | Hebert | 74/503 X |
| 3,165,612 | 1/1965 | Bailey | 200/153 J X |
| 3,200,657 | 8/1965 | Barden et al. | 200/153 J X |
| 3,457,377 | 7/1969 | Olson | 200/328 X |

*Primary Examiner*—Stephen Marcus

*Attorney, Agent, or Firm*—Brown, Flick & Peckham

[57] ABSTRACT

A push button adapter has a housing with an open bottom mounted on top of a slide switch, with the actuating button of the switch extending up into the housing. Slidably mounted in the housing and extending out of one end of it is a push button plunger with a recess therein loosely receiving the actuating button for moving it with the plunger. A coil spring normally holds the plunger in its outermost position with the button at one end of its travel, the plunger being movable into the housing far enough to move the button to its other position. Rotatably mounted in the top of the housing above the plunger is a latch that is turned by means on top of the inwardly moving plunger from a normal position only far enough for it to stop outward movement of the released plunger before it can move the button, the latch turning means being adapted to turn the latch past its plunger-stopping position when the plunger is pushed inwardly against and to then turn the latch to its normal position when the plunger is released so that the plunger will return the button to its original position.

6 Claims, 10 Drawing Figures

Fig. 1
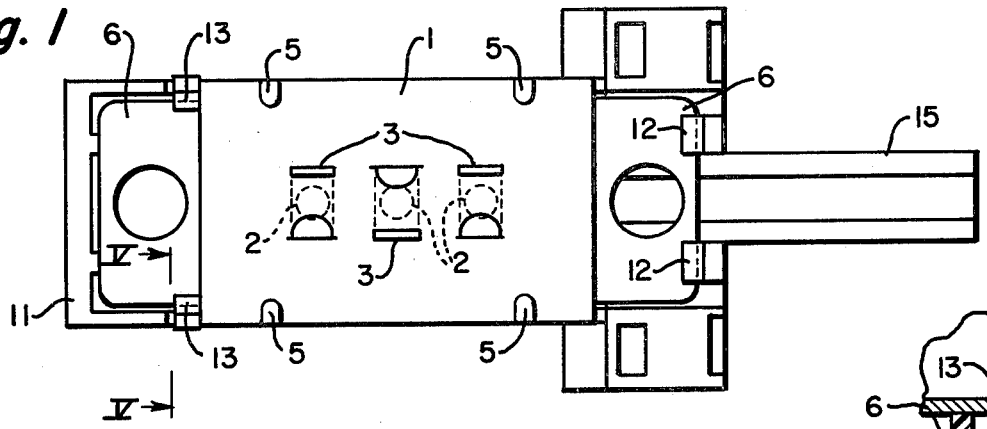
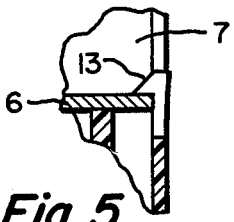
Fig. 5
Fig. 2
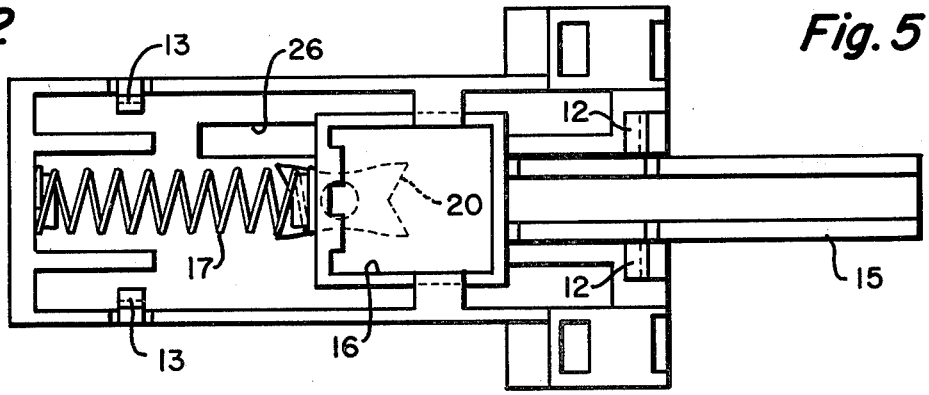
Fig. 3
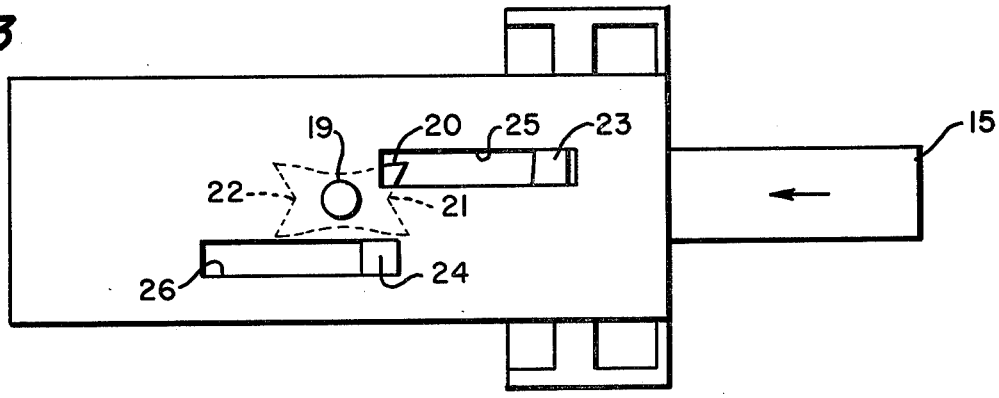
Fig. 4
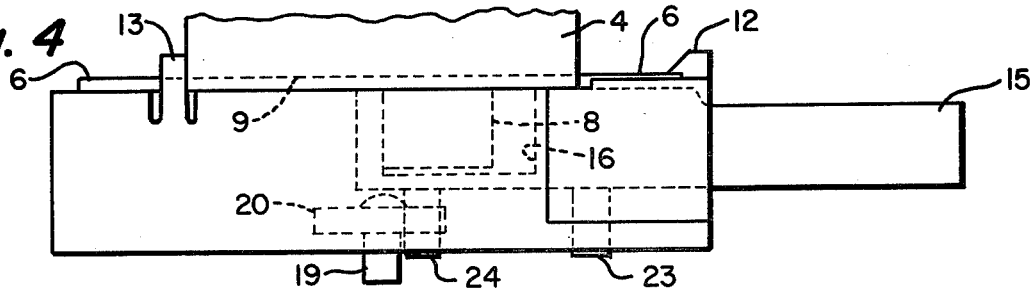

PUSH BUTTON ADAPTER FOR SLIDE SWITCH

There is a conventional or standard type of slide switch in which a contact-moving member is provided with a button that extends up through a longitudinal slot in the top wall of the switch case. Switching is accomplished by moving the button to one end or the other of the slot. There also are push button switches of the push-release type in which a push button plunger is pushed lengthwise of a switch housing to move a contact from a first position to a second position. When the plunger is released a spring pushes it only part way back toward its outermost position without moving the switch contact. The next time the plunger is pushed and released it moves the switch contact back to its original position. Thus, it requires two pushes on the plunger to move the contact from one position to the other and back again.

It is among the objects of this invention to provide an adapter that can be attached to a standard slide switch in order to convert it into a push button switch of the latch and release type. Another object is to provide such an adapter of inexpensive construction, which can be quickly attached to a slide switch without any tools or separate fastening members.

The preferred embodiment of the invention is illustrated in the accompanying drawings, in which FIG. 1 is a bottom view of the device;

FIG. 2 is a similar view, but with the slide switch removed to show the inside of the adapter;

FIG. 3 is a plan view;

FIG. 4 is a side view with the switch broken away;

FIG. 5 is a fragmentary vertical section taken on the line V—V of FIG. 1;

Figure 6:
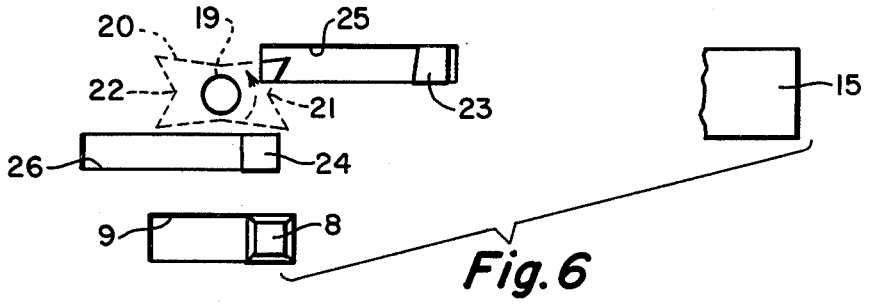
FIG. 6 is a diagram indicating the positions of the actuating members when the switch is in "off" position.

Referring to the drawings, a conventional slide switch is shown that has an insulating base 1 on which there is a line of fixed contacts 2 with integral terminals 3 extending down through the base. Attached to this base is an inverted channel shape metal case 4 (FIG. 4) having a top wall parallel to the base and having side walls with tabs 5 at their lower edges bent under the base to connect the two members together. The top wall of the case has end portions 6 that extend outwardly away from the case. Inside the case there is a slide 7 (FIG. 5) provided with a recess containing the usual bridging contact (not shown) for engaging two of the fixed contacts 2 at the same time. The top of this slide is provided with a button 8 (FIG. 4) that extends through a longitudinal slot 9 in the top wall of the case. By moving the button from one end of the slot to the other, switching can be accomplished.

In accordance with this invention, this slide switch can be converted into a push button switch of the push-latch push-release type by an adapter attached to the switch. The adapter includes a rectangular molded plastic housing 11 that has an open bottom for receiving the switch button 8. One end of the housing is provided with a pair of downwardly extending integral hooks 12 for hooking under the end of the top wall extension 6 at one end of the switch. Near the opposite end of the housing it is provided at opposite sides with integral spring hooks 13 that straddle and hook under opposite edges of the top wall extension at that end of the switch. These hooks also engage the adjoining ends of the side walls of the case to keep the far extension 6 engaged by hooks 12. The housing is applied to the switch by inserting one end of the top wall of the case under the two end hooks 12 and then pressing down on the opposite end of the top wall to cause it to snap between the two spring hooks at that end. Nothing more is required to firmly connect the adapter and switch together.

A push button plunger 15 extends through a notch in one end of the adapter housing. The outer end of the plunger is formed for receiving a push button (not shown) of any desired shape. The inner end portion of the plunger inside the housing is enlarged and slides on the top wall of the switch case. As shown in FIG. 2, it is provided with a recess 16 that receives the switch button so that when the plunger is moved back and forth in the housing the button will be moved from one end of the switch slot 9 to the other. The length of the recess measured lengthwise of the housing is somewhat greater than the length of the button in the same direction, so there is lost motion between the button and plunger for a purpose which will be explained.

The plunger normally is held in its outermost position by means of a coil spring 17 compressed between its inner end and the adjacent end of the housing. The wall of the recess at the inner end of the plunger normally engages the slide button and holds it at the adjacent end of the switch slot as indicated in FIG. 4. When the plunger is pushed into the housing to its innermost position, the opposite wall of the recess will first move toward the button and then engage it and move it to the opposite end of the slot.

The housing is provided with a central hole above the plunger recess when the latter is in its outer position. Rotatably mounted in this opening is the stem 19 of a latch 20 disposed between the top of the plunger and the top of the housing. When the plunger is in its outer position, the latch extends lengthwise of the plunger and housing as shown in FIGS. 2 and 3. In the ends of the latch there are tapered notches 21 and 22, the sides of each of which are disposed at approximately 120° to each other, although the exact angle is not critical. Extending upwardly from the top of the plunger are two pins 23 and 24 that also extend up into two slots 25 and 26, respectively, that extend lengthwise of the top of the housing. The pins and slots are spaced laterally and also are staggered lengthwise of the housing. Slot 25 extends from a point near the latch stem toward the outer end of the housing. The other slot extends from substantially the inner end of slot 25 toward the opposite end of the housing. When the plunger is in its outer position, the pins are in the ends of the slots closest to the notched end of the housing.

Figure 7:
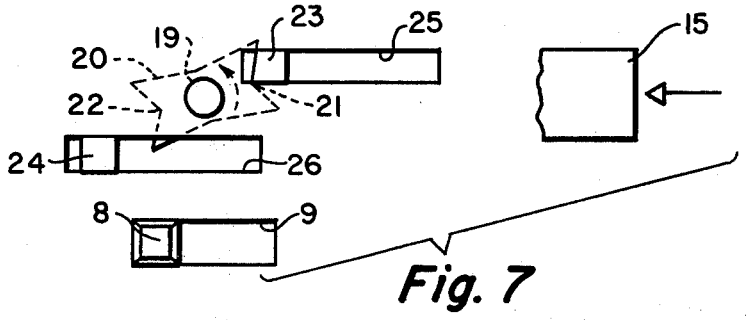
FIG. 7 shows the switch button pushed to "on" position.

One end of the latch in its normal position, usually the "off" position, extends part way into the path of travel of the outer pin 23. When the plunger is pushed in to move the switch button to the opposite end of the switch case slot 9 from the "off" position shown in FIGS. 3 to 6 to the "on" position, this pin engages the latch 20 and turns it a few degrees so that its opposite end projects into the return path of the other pin as shown in FIG. 7. To avoid confusion in FIGS. 6 to 10, switch button 8 and switch slot 9 have been shown at one side of the latch instead of directly below it.

Figure 8:
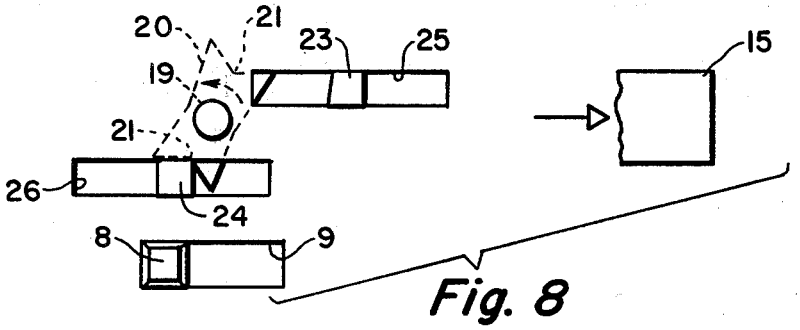
FIG. 8 shows the plunger released.

When the plunger is released, the coil spring moves it outwardly, but the inner pin 24 enters notch 22 and engages the end of the latch and turns it a few degrees before the latch stops further movement of the pin as shown in FIG. 8. Pin 24 stops before the plunger can move the button.

Figure 9:
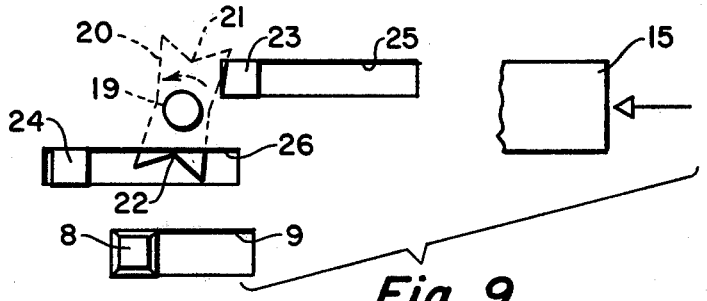
FIG. 9 shows the plunger pushed in again.
Figure 10:
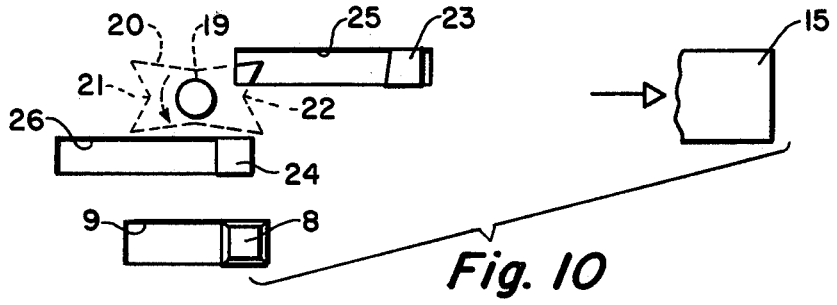
FIG. 10 shows the plunger released, with the parts returned to the "off" position.

To return the button to its original position, the plunger is again pushed into the housing, which causes the outer pin 23 to enter notch 21 and turn the latch a few more degrees as shown in FIG. 9, so that when the plunger is released the spring will cause the inner pin 24 to engage the side of the latch and swing it around into its normal position extending lengthwise of the housing as shown in FIG. 10. This allows the plunger to return to its outermost position and to carry the switch button along with it to that end of the case slot. It will be seen from these diagrams that when the plunger moves the button to the left-hand end of slot 9 and then returns it to its original position at the right-hand end, the latch is turned 180°.

With this invention, a conventional slide switch can quickly be converted to a push button switch of the push-latch, push-release type by simply snapping the switch and adapter together.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. The combination with a slide switch having an actuating button extending through a longitudinal slot in the top wall of the switch case, of an adapter for converting the switch into a push button switch, said adapter comprising a housing having an open bottom mounted on top of the switch with said actuating button extending up into the housing, means on the housing attaching it to the switch, a push button plunger slidably mounted in the housing and extending out of one end of it, the plunger having a recess therein loosely receiving said actuating button for moving it with the plunger, a coil spring compressed between the inner end of the plunger and the opposing end wall of the housing for normally holding the plunger in its outermost position with said button at one end of said slot, the plunger being movable into the housing far enough to move said button to the opposite end of said slot, a latch rotatably mounted in the top of the housing above the plunger, and means on top of the inwardly moving plunger for turning the latch from a normal position only far enough for it to stop outward movement of the released plunger before the plunger can move said button away from said opposite end of the slot, said latch-turning means being adapted to turn the latch past said plunger-stopping position when the plunger is pushed inwardly again and to then turn the latch to its normal position when the plunger is released so that the plunger will return said button to said one end of said slot.

2. The combination recited in claim 1, in which said attaching means include spring hooks extending downwardly from said housing and hooked onto the switch case.

3. The combination recited in claim 1, in which said housing is made from a plastic and said hooks are integral with it.

4. The combination recited in claim 1, in which the top wall of said switch case projects from opposite ends of the case, and said attaching means include a spring hook extending downwardly from one end of said housing and hooked onto the end of the wall projection at one end of the case, and a pair of spring hooks extending downwardly from opposite sides of the housing and straddling the wall projection at the other end of the case.

5. The combination recited in claim 1, in which said latch-turning means are a pair of pins projecting into longitudinal slots in the top of said housing, said pins being spaced laterally and longitudinally of said plunger and housing.

6. The combination recited in claim 5, in which said slots are staggered lengthwise of said housing, and said pins are engageable with the opposite ends of said latch alternately as the plunger moves in and out.

* * * * *